US007063438B2

(12) United States Patent
Sze-Tai

(10) Patent No.: US 7,063,438 B2
(45) Date of Patent: Jun. 20, 2006

(54) MULTI-PURPOSE SPOTLIGHT AND POWER STATION

(76) Inventor: Yung Sze-Tai, Room 717, Nam Lok Lau, Nam Shan Estate, Kowloon (HK)

( * ) Notice: Subject to any disclaimer, the term of this patent is extended or adjusted under 35 U.S.C. 154(b) by 134 days.

(21) Appl. No.: 10/797,649

(22) Filed: Mar. 10, 2004

(65) Prior Publication Data

US 2005/0024861 A1 Feb. 3, 2005

Related U.S. Application Data

(63) Continuation-in-part of application No. 29/187,298, filed on Jul. 30, 2003, now Pat. No. Des. 511,851.

(51) Int. Cl.
*F21L 4/04* (2006.01)

(52) U.S. Cl. ..... 362/199; 362/157; 362/184; 362/205; 362/208

(58) Field of Classification Search ..... 362/192, 362/199, 228, 295, 800, 157, 205, 208, 234, 362/235, 251, 184
See application file for complete search history.

(56) References Cited

U.S. PATENT DOCUMENTS

| | | | | |
|---|---|---|---|---|
| 3,030,497 | A * | 4/1962 | Cheng | 362/184 |
| 5,019,951 | A | 5/1991 | Osterhout et al. | |
| 5,469,346 | A * | 11/1995 | Haut et al. | 362/205 |
| 5,859,582 | A * | 1/1999 | Yuen | 340/326 |
| D418,237 | S | 12/1999 | Yuen | |
| D432,691 | S | 10/2000 | Meoli, Jr. | |
| D440,334 | S | 4/2001 | Yuen | |
| D445,207 | S | 7/2001 | Yuen | |
| 6,419,377 | B1 | 7/2002 | Yuen | |
| D463,592 | S | 9/2002 | Han-Shim | |
| D474,552 | S | 5/2003 | Poon | |
| D479,889 | S | 9/2003 | Poon | |
| D483,137 | S | 12/2003 | Yuen | |
| D484,626 | S | 12/2003 | Hanselman et al. | |
| D485,383 | S | 1/2004 | Hanselman et al. | |
| 6,789,924 | B1 | 9/2004 | Yuen | |
| D505,507 | S | 5/2005 | Han Shim | |
| 2003/0179573 | A1 * | 9/2003 | Chun | 362/200 |
| 2003/0223227 | A1 | 12/2003 | Levine | |

OTHER PUBLICATIONS

U.S. Appl. No. 29/187,298, filed Jul. 30, 2003, Yung
U.S. Appl. No. 29/197,312, filed Jan. 13, 2004, Chen.

* cited by examiner

*Primary Examiner*—Stephen Husar
*Assistant Examiner*—Meghan Dunwiddie
(74) *Attorney, Agent, or Firm*—Roy, Kiesel et al.

(57) ABSTRACT

According to the present invention, the device disclosed is a unified structure which combines various implements useful for automotive applications. Such implements include various lighting devices, a range of power outlets, signal lamps and more. The present invention also includes an independent power supply for such devices as well as the ability to be powered from an outside source, such as a vehicle.

41 Claims, 5 Drawing Sheets

MULTI-PURPOSE SPOTLIGHT AND POWER STATION

This application is a continuation-in-part of U.S. patent application Ser. No. 29/187,298, filed on Jul. 30, 2003 now U.S. Pat. No. D511851 which is hereby incorporated by reference in its entirety.

BACKGROUND OF THE INVENTION

The present invention relates to a multi-purpose device which provides various functions to travelers. Specifically, a device for use with twelve volt power systems of automobiles which provides lighting, power outlets, and more is disclosed.

Due to the dynamic nature of an automotive traveler's needs, and because of the restricted physical space generally available in automotive conveyance, it is desirable to combine the functions of several devices into a unitary design. This advantage, coupled with an offering of well-thought out additions, makes the present invention a novel and useful product offering.

Various types of automotive devices have been introduced to the market, however, no device introduced previously nor now available combines the functions present in the current invention, nor do they offer the innovative features contained therein.

The present invention alleviates this lack of product offering by supplying a device which combines several handy, or in some cases, essential articles into one, and further, incorporates new features not ordinarily seen in such an application, such as voltage converters. These aspects are then packaged into a product having a small footprint and one which is easily portable.

OBJECTS OF THE INVENTION

One objective of this invention is to provide various signal lamps for emergencies and other signaling uses.

Another objective of this invention is to provide a device which provides various illuminating devices for lighting of broad areas, as well as precision lighting.

Still another objective of the invention is to provide a device which provides various outlets for powering other devices.

Yet another objective of the present invention is to provide a device that combines several such devices which are useful for automotive travelers into a unitary form factor.

Yet another objective of the invention is to provide such a device in a small and easily portable form factor.

Still another objective of this invention is to fill a long felt need in the art for such devices, since as far as is known, there is no such device that will provide the functionality and convenience of the present invention.

Other objects and advantages of this invention shall become apparent from the ensuing descriptions of the invention.

SUMMARY OF THE INVENTION

According to the present invention, the device disclosed is a unified structure which combines various implements useful for automotive applications. Such implements include various lighting devices, a range of power outlets, signal lamps and more. The present invention also includes an independent power supply for such devices as well as the ability to be powered from an outside source, such as a vehicle.

DESCRIPTION OF THE DRAWINGS

The accompanying drawings illustrate a preferred embodiment of this invention. However, it is to be understood that this embodiment is intended to be neither exhaustive, nor limiting of the invention. They are but examples of some of the forms in which the invention may be practiced.

DETAILED DESCRIPTION OF THE PREFERRED EMBODIMENT

Figure 1:
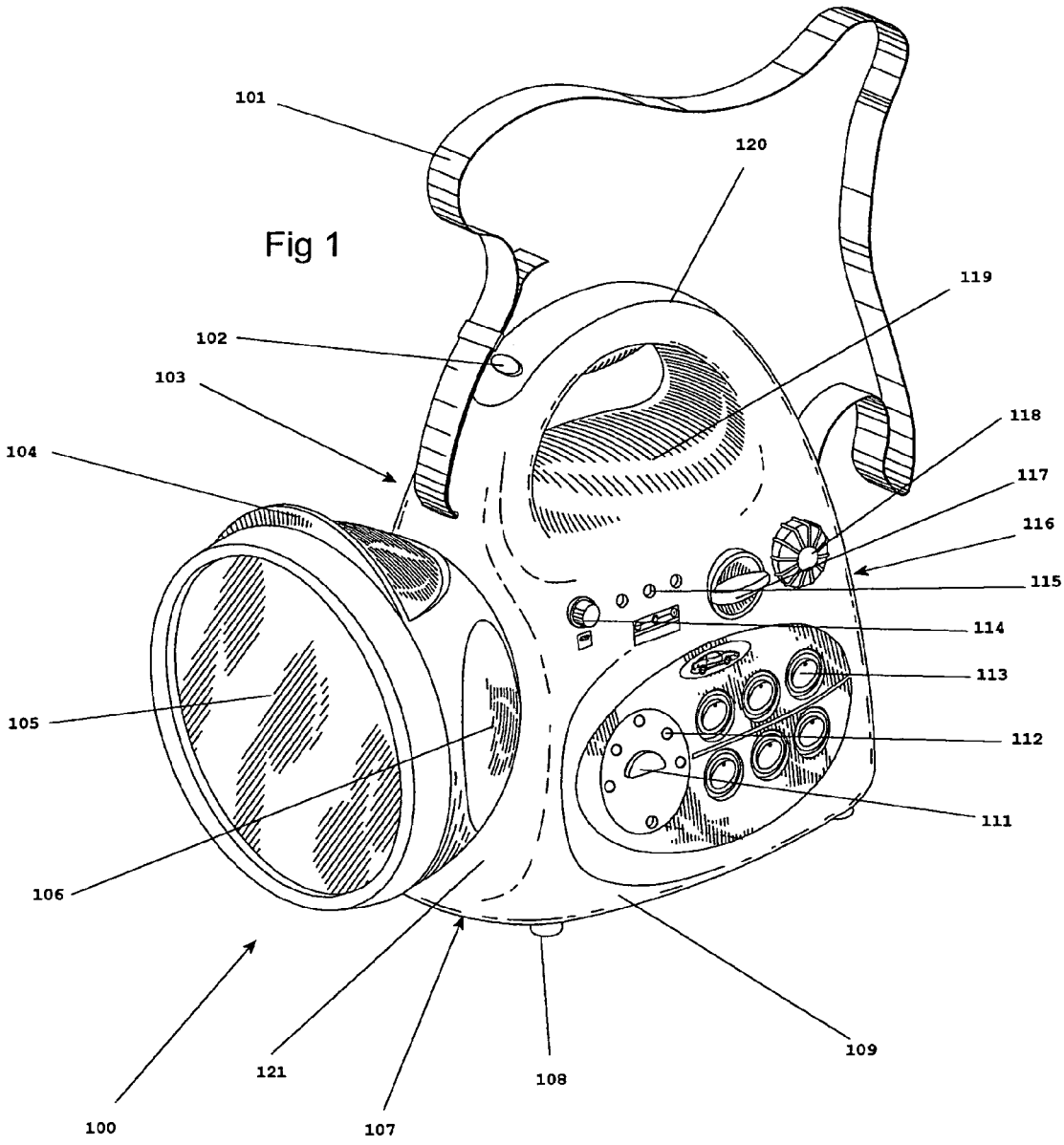
FIG. 1 shows a perspective view of the multi-purpose device.
Figure 2:
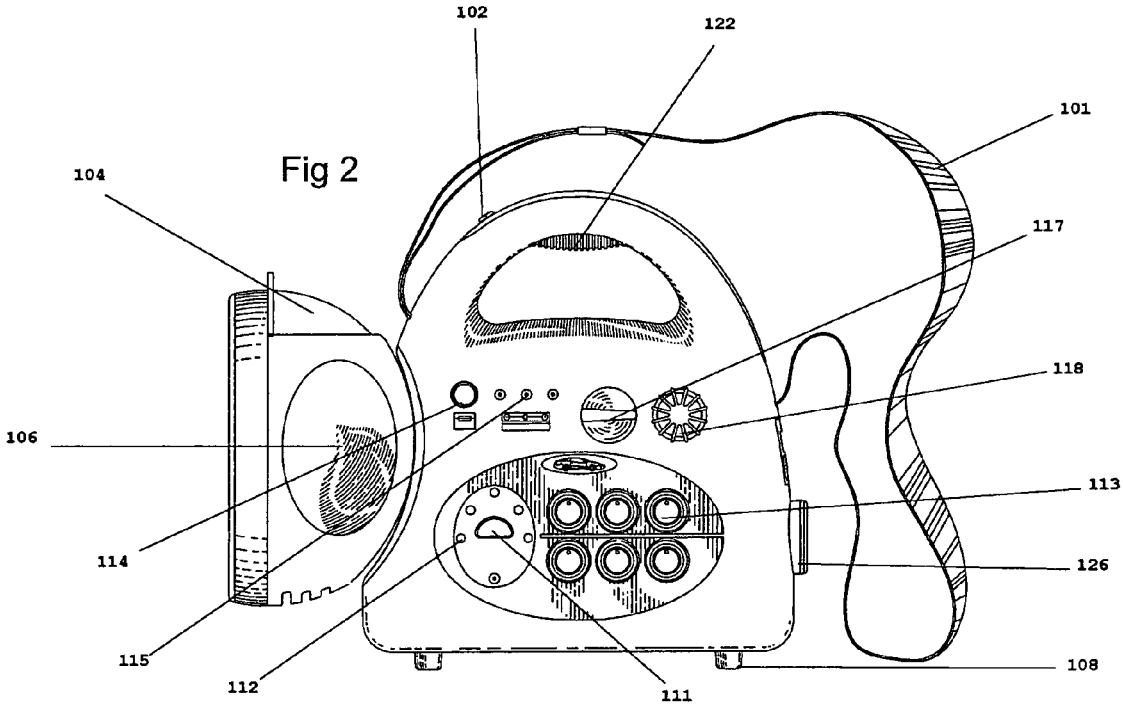
FIG. 2 shows a side view of the multi-purpose device from the left side.
Figure 3:
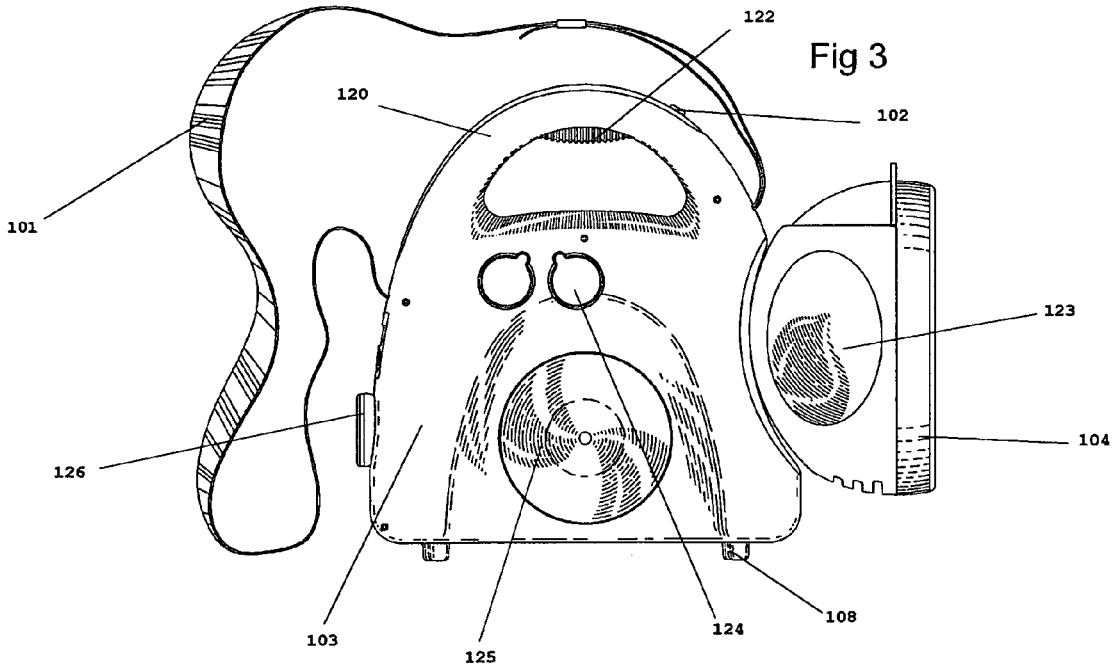
FIG. 3 shows a side view of the multi-purpose device from the right side.
Figure 4:
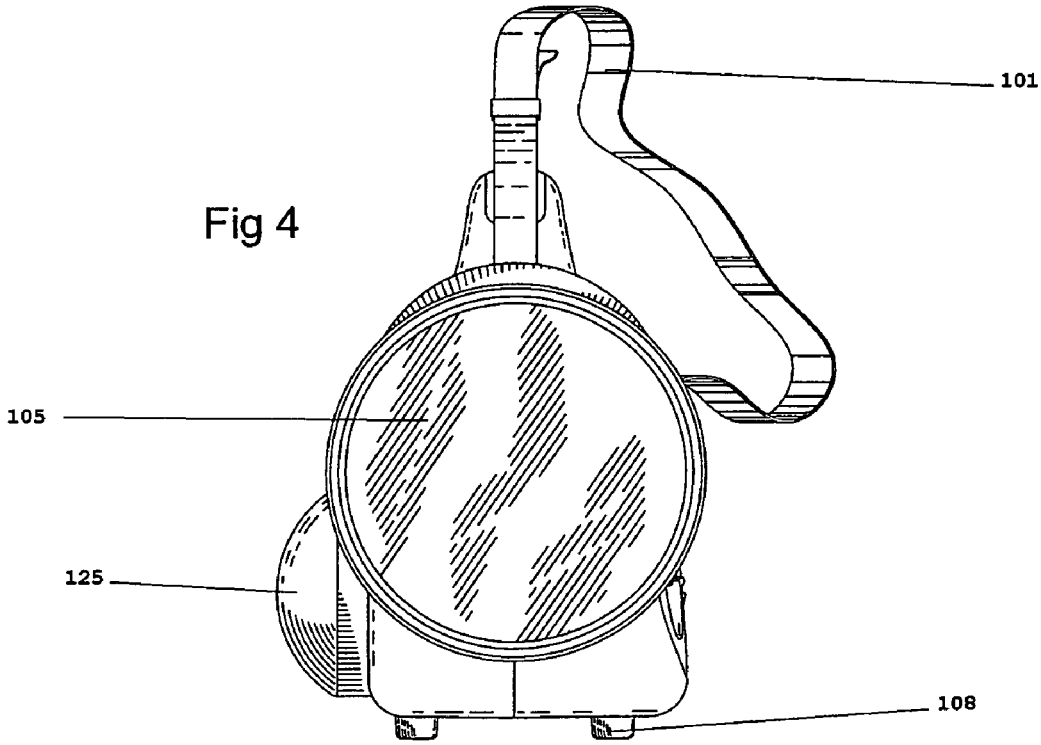
FIG. 4 shows a front view of the multi-purpose device.
Figure 5:
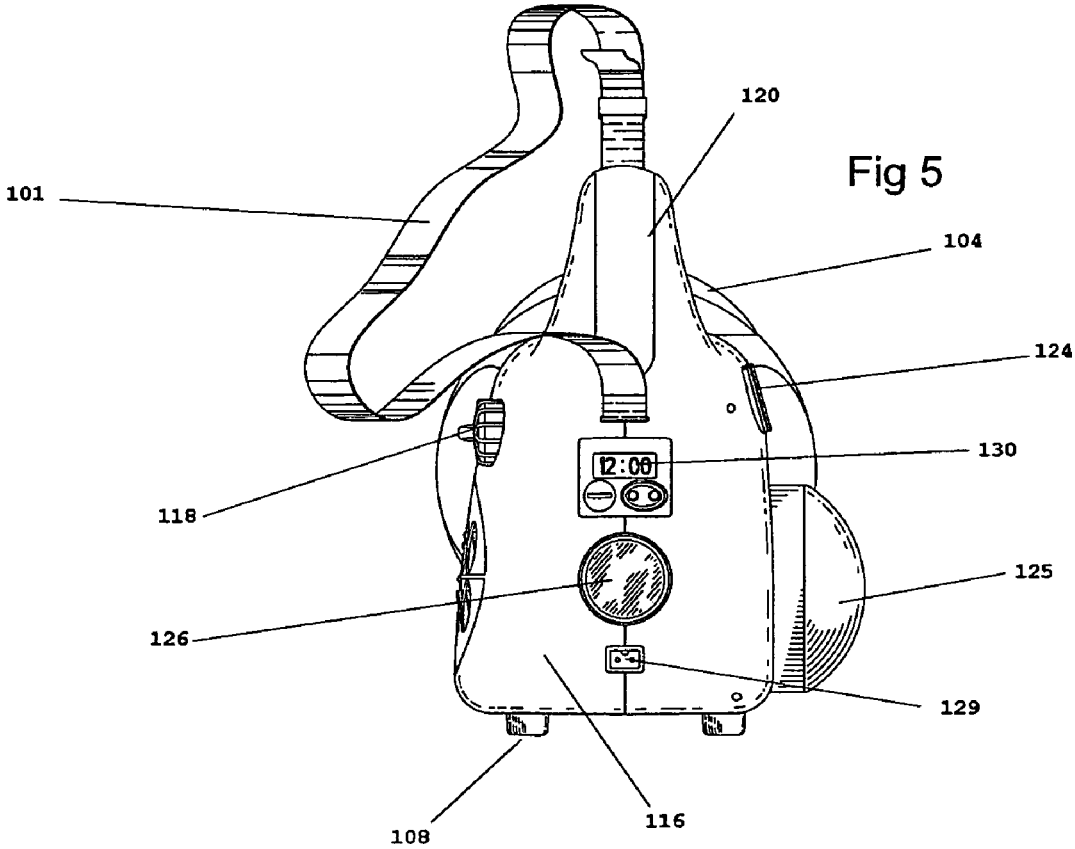
FIG. 5 shows a rear view of the multi-purpose device.
Figure 6:
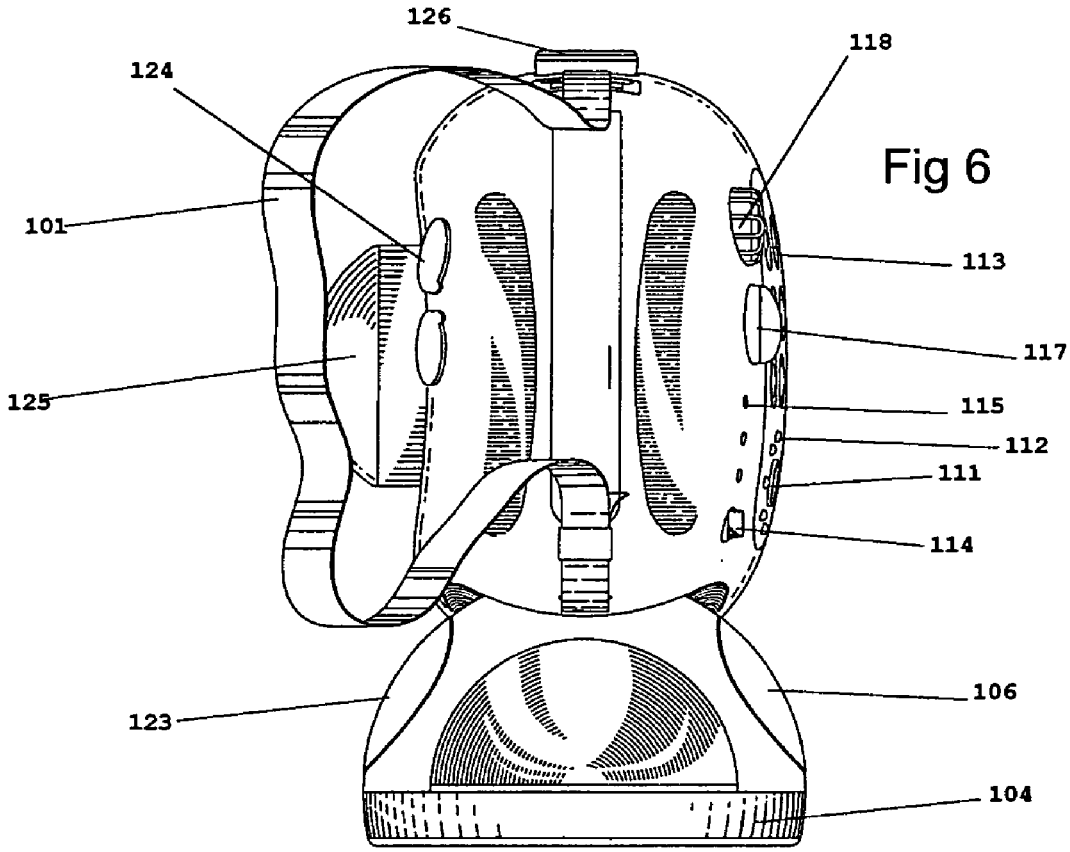
FIG. 6 shows a top view of the multi-purpose device.
Figure 7:
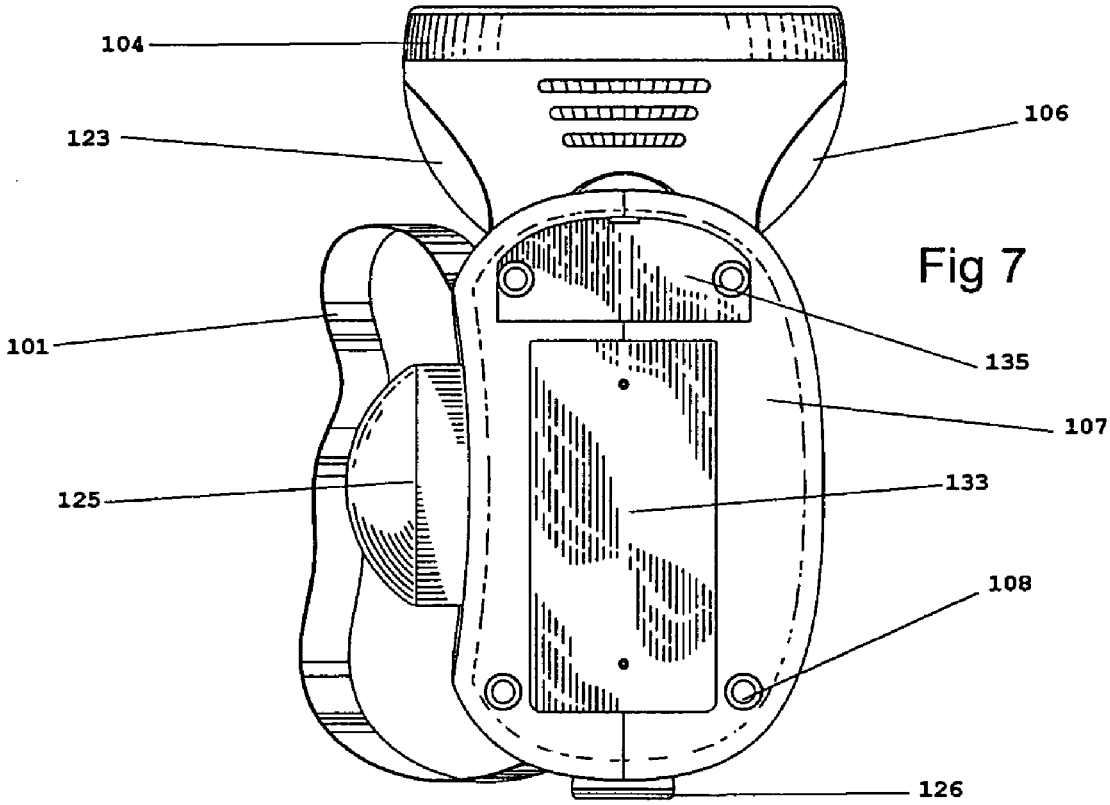
FIG. 7 shows a bottom view of the multi-purpose device.
Figure 8:
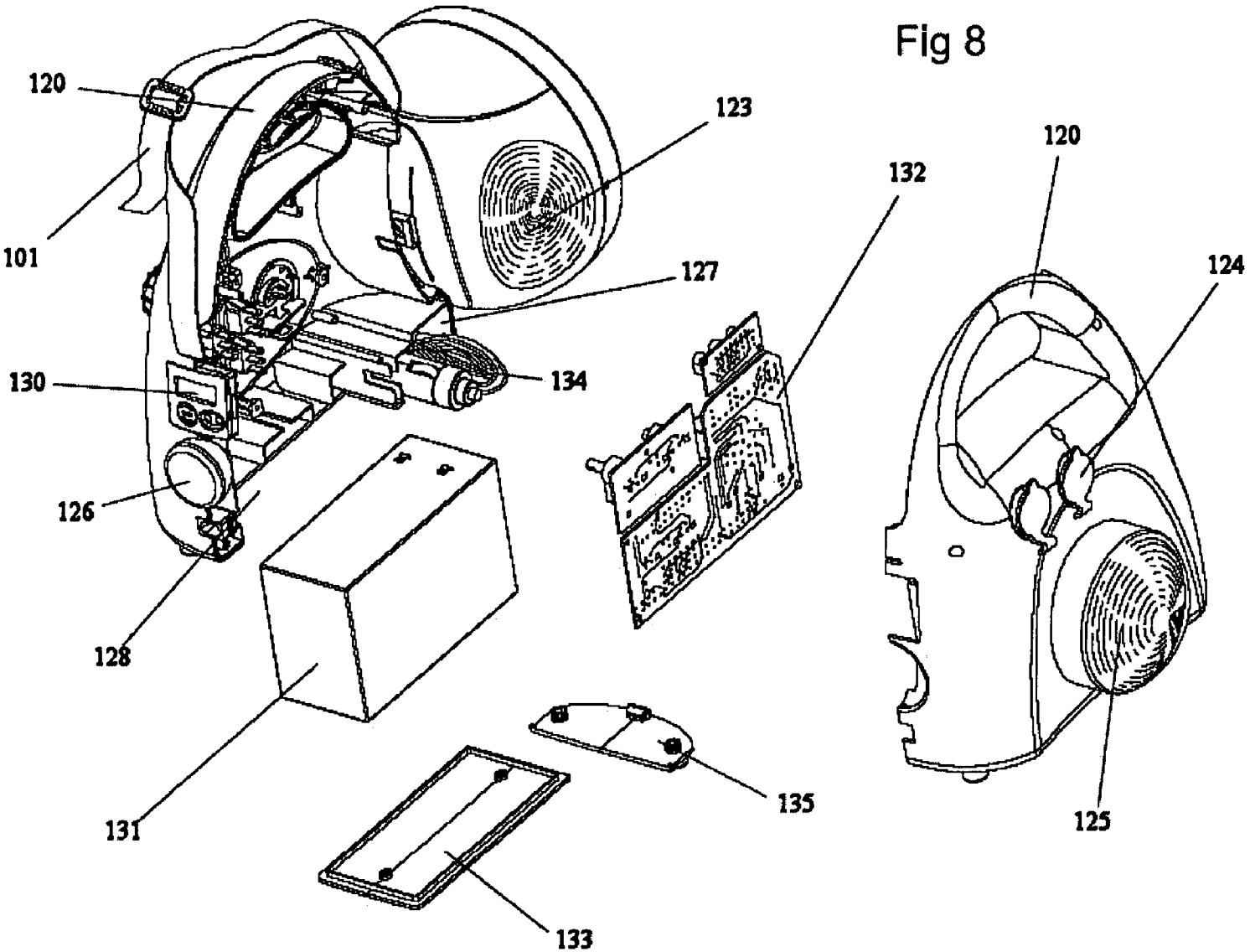
FIG. 8 shows an exploded view of the multi-purpose device.

Without any intent to limit the scope of this invention, reference is made to the figures in describing the preferred embodiments of the invention. Referring to FIGS. 1 through 8, body 100 is pictured, which serves as the housing for the invention disclosed. Such body 100 is formed by front wall 121, rear wall 116, first side wall 109, second side wall 103, top wall 119, and base 107. These outer walls are where most components of the invention are located.

Handle 120 is formed in the top of body 100 so that the device can be easily carried. Another method of carrying the device is the use of strap 101 which is attached at at least two points on body 100, such as two opposite ends of top wall 119 as shown in the FIGs.

Power hub 132 is, in the exemplary embodiment, located within body 100, and serves to distribute power received from an energy source, such as from external power receptacle 129 and/or energy cell 131 to the device's components. Either power source may be used to provide current to the device. An exemplary embodiment would include the ability to charge energy cell 131 while simultaneously providing power to the device. Other examples of energy sources include wall outlets, car electrical outlets, batteries, solar panels, fossil fuels and the like.

The components of the device include a spotlight housing 104 located on front wall 121, which is used to house spotlight 105, first side light module 106 and second side light module 123. In the exemplary embodiment, spotlight housing 104 mentioned above also has on either side of it colored lenses or lamps which can be used for signaling or emergency use. Such colored lenses include a configuration with first side light module 106 on the first side of body 100, and second side light module 123 located on the second side of body 100, although it should be apparent that various configurations are possible, and the colors may be varied.

In the exemplary embodiment, the left side of body 100 has additional other items therein. Switch bank 113 contains several switches which control the various devices of the invention, such as spotlight 105, first side light module 106, second side light module 123, outlets 124, flood light 125 and swivel head Light Emitting Diode (LED) torch 126. An additional momentary switch 102 can be employed to momentarily interrupt the flow of current to spotlight 105 so that it may be momentarily turned off, for signaling, or when it is desired to temporarily shut off spotlight 105. In the exemplary embodiment presented, momentary switch 102 is located in handle 120 for ease of access while holding the device. When momentary switch 102 is activated, is can thus be operated as a flasher or signaling device, or simply a temporary disabling of spotlight 105. Activation can be the pressing of a switch, position change of a switch, or various other means of switch implementation. All of these switches are connected to power hub 132 and to the respective feature, completing an electrical circuit. Again, the choice in the exemplary embodiment of the "left" and "right" sides is flexible, and further, the device may be configured with the components in various locations, not necessarily the "sides."

Also on the body is an indicator 112 which is used in conjunction with tester switch 111 to ascertain the status of the onboard energy cell 131, which can be a battery, or other storage device for energy, and stored in energy cell cavity 128, typically located in base 107 of the device. There may also be a door on the energy cell cavity 128 to enclose energy cell cavity 128. Also, external power receptacle 129 is near indicator 112 which is used to recharge energy cell 131 or to provide power to the device.

Indicator 112 can be a series of LEDs which each are energized by a different current, and are arranged in ascending order of current draw. When tester switch 111 is activated, it permits current to flow from energy cell 131 or external power receptacle 129 through indicator 112 such that only the LEDs which correspond to the present level of current will be energized. Essentially, as energy cell 131 is depleted, or external power source weakened, fewer LEDs will be energized, thus graphically illustrating the power remaining in energy cell 131 or at external power receptacle 129.

Alternately, indicator 112 can utilize an electronic circuit to measure the current in energy cell 131 or current derived from external power receptacle 129 and report the same by energizing the appropriate indicator 112. This has the effect of displaying a meter which indicates the condition of energy source, permitting the user to ascertain the status of the device.

Also on body 100 is dimmer switch 118, which is connected in series from power hub 132 to spotlight 105 such that the voltage flowing from power hub 132 to spotlight 105 is regulated, and can be lowered or increased according to need. This has the advantage of providing a specific amount of light, wherein energy may be conserved in energy cell 131 by not using the full power draw of spotlight 105.

Switch 117 is utilized as a switch to control the powering on and off of the entire device deactivating power hub 132, and can be located in various places on body 100. In series with switch 117 or in an appropriate circuitous location on power hub 132 would be fusible link 114, which is utilized to prevent current overloads. As in a typical fused application, if the current were to reach a predetermined point at which it was known that damage would be likely, fusible link 114 would interrupt the circuit to prevent such damage. In the exemplary embodiment, this fusible link 114 is in first side wall 109, and is in the form of a fuse, which interrupts the circuit by destroying itself under a heavy amperage load. It should be noted that this may also be a circuit breaker, or any other means of amperage control device, if desired or needed in a particular application. Fusible link 114 can be positioned between external power receptacle 129 or energy cell 131 and power hub 132, or between power hub 132 and the load-bearing circuits for the various other items in the device.

On any of the walls can also reside regulated energy outlets 115 which are configured to provide varying levels of voltage for myriad electronic devices which require reduced voltage, such as portable CD players, radios and the like. Energy outlets 115 are connected to the appropriate switch within switch bank 113 and in turn to power hub 132.

In the exemplary embodiment, the side of the device opposite switch bank 113 contains flood light 125 which can be used to illuminate a wide area versus the relatively tight pattern of a spotlight. Another lighting option is swivel head Light Emitting Diode (LED) torch 126, which is located in the rear of the unit in the example embodiment of the drawings, but can be placed anywhere on the unit. Both flood light 125 and swivel head LED torch 126 are connected to a discrete switch within switch bank 113, and thus in turn to power hub 132.

Also near the rear of the unit, clock 130 is pictured which can be any number of timekeeping varieties, such as an analog clock, digital clock, stopwatch, or the like. Clock 130 may derive power from the power hub 132, or may have an independent energy cell with which to power itself, or to provide a non-volatile power source for clock's 130 memory.

An alternative to using energy cell 131 is to connect the unit to an off board or external power source via connecting cord 134 to external power receptacle 129. This could include a 12 v automotive source, or even an AC source, depending upon the application. Cord 134 may be stowed within cord storage cavity 127, located within base 107, when not in use. If desired, vents may be included in body 100 in order to cool various parts of the device.

In operation, switch 117 is turned on once cord 134 is attached to external power receptacle 129 to provide power. Instead of cord 134, energy cell 131 may be used, once sufficient charging is reached via inputting power from an outside source to external power receptacle 129. In this manner, power hub 132 is energized, and is able to provide power to its connected devices and switch bank 113, which, in turn, powers connected devices such as spotlight 105, first side light module 106, energy outlets 124 and so forth, as well as charging energy cell 131, if so configured.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims.

The invention claimed is:

1. A multipurpose mobile device comprising:

a. a body having a first side wall, a second side wall, a front wall, a rear wall, a top wall and a base;

b. said body containing an energy source operatively connected to a power hub configured to distribute energy within said device;

c. spotlight operatively attached to said body and to said power hub; and d. at least one energy outlet configured in said body, said outlet operatively connected to said power hub.

2. The multipurpose mobile device of claim 1, wherein said spotlight is mounted in a spotlight housing, and wherein said spotlight housing is pivotally mounted to said body.

3. The multipurpose mobile device of claim 2, further comprising a dimming switch operatively connected between said spotlight and said energy source, said dimming switch configured to control the voltage delivered to said spotlight, whereby the output of said spotlight may be increased or decreased as desired.

4. The multipurpose mobile device of claim 3, further comprising a switch operatively integrated in said body and configured to momentarily interrupt the current to said spotlight when said switch is activated, whereby said spotlight may be operated as a flasher.

5. The multipurpose mobile device of claim 4, further comprising a flood light operatively attached to said body and having an operable connection to said power hub.

6. The multipurpose mobile device of claim 5, further comprising a light emitting diode (LED) torch attached to said body, and operatively connected to said power hub.

7. The multipurpose mobile device of claim 5, wherein said energy source is an energy cell, and wherein said body further comprises a visual indicator operatively connected to said energy source, said visual indicator configured to vary in appearance in relation to the current delivered to said power hub by said energy source.

8. The multipurpose mobile device of claim 7, said body further comprising a clock mounted in said body.

9. The multipurpose mobile device of claim 8, further comprising at least one side light module operatively mounted in said spotlight housing, and operatively connected to said power hub.

10. The multipurpose mobile device of claim 9, wherein said side light module is configured to emit light that is amber in color.

11. The multipurpose mobile device of claim 9, wherein said side light module is configured to emit light that is red in color.

12. The multipurpose mobile device of claim 1, further comprising a dimming switch operatively connected between said spotlight and said energy source, said dimming switch configured to control the voltage delivered to said spotlight, whereby the output of said spotlight may be increased or decreased as desired.

13. The multipurpose mobile device of claim 12, further comprising a switch operatively integrated in said body and configured to momentarily interrupt the current to said spotlight when said switch is activated, whereby said spotlight may be operated as a flasher.

14. The multipurpose mobile device of claim 13, further comprising a flood light operatively attached to said body and having an operable connection to said power hub.

15. The multipurpose mobile device of claim 14, further comprising a light emitting diode (LED) torch attached to said body, and operatively connected to said power hub.

16. The multipurpose mobile device of claim 15, wherein said energy source is an energy cell, and wherein said body further comprises a visual indicator operatively connected to said energy source, said visual indicator configured to vary in appearance in relation to the current delivered to said power hub by said energy source.

17. The multipurpose mobile device of claim 16, said body further comprising a clock mounted in said body.

18. The multipurpose mobile device of claim 17 wherein said energy source is at least one of the following group:

a. an energy cell;

b. an electrical wall socket; or c. an automotive power socket.

19. The multipurpose mobile device of claim 1, further comprising a switch operatively integrated in said body and configured to momentarily interrupt the current to said spotlight when said switch is activated, whereby said spotlight may be operated as a flasher.

20. The multipurpose mobile device of claim 19, further comprising a flood light operatively attached to said body and having an operable connection to said power hub.

21. The multipurpose mobile device of claim 20, further comprising a light emitting diode (LED) torch attached to said body, and operatively connected to said power hub.

22. The multipurpose mobile device of claim 21, wherein said energy source is an energy cell, and wherein said body further comprises a visual indicator operatively connected to said energy source, said visual indicator configured to vary in appearance in relation to the current delivered to said power hub by said energy source.

23. The multipurpose mobile device of claim 22, said body further comprising a clock mounted in said body.

24. The multipurpose mobile device of claim 1, further comprising a flood light operatively attached to said body and having an operable connection to said power hub.

25. The multipurpose mobile device of claim 24, further comprising a light emitting diode (LED) torch attached to said body, and operatively connected to said power hub.

26. The multipurpose mobile device of claim 25, wherein said energy source is an energy cell, and wherein said body further comprises a visual indicator operatively connected to said energy source, said visual indicator configured to vary in appearance in relation to the current delivered to said power hub by said energy source.

27. The multipurpose mobile device of claim 26, said body further comprising a clock mounted in said body.

28. The multipurpose mobile device of claim 1, further comprising a light emitting diode (LED) torch attached to said body, and operatively connected to said power hub.

29. The multipurpose mobile device of claim 28, wherein said energy source is an energy cell, and wherein said body further comprises a visual indicator operatively connected to said energy source, said visual indicator configured to vary in appearance in relation to the current delivered to said power hub by said energy source.

30. The multipurpose mobile device of claim 29, said body further comprising a clock mounted in said body.

31. The multipurpose mobile device of claim 30, wherein said light emitting diode torch is a swivel-head LED torch.

32. Amended) The multipurpose mobile device of claim 1, wherein said energy source is an energy cell, and wherein said body further comprises a visual indicator operatively connected to said energy source, said visual indicator configured to vary in appearance in relation to the current delivered to said power hub by said energy source.

33. The multipurpose mobile device of claim 32, said body further comprising a clock mounted in said body.

34. The multipurpose mobile device of claim 33, wherein said at least one energy outlet is further configured to provide regulated current.

35. The multipurpose mobile device of claim 34, wherein said at least one energy outlet is further configured to provide electrical current at levels selected from the group comprising 3, 5, 9 or 12 volts.

36. The multipurpose mobile device of claim 1, wherein said energy source is an energy cell, and wherein said body further comprises a visual indicator operatively connected to said energy source, said visual indicator configured to vary in appearance in relation to the current delivered to said power hub by said energy source.

37. The multipurpose mobile device of claim 36, said body further comprising a clock mounted in said body.

38. The multipurpose mobile device of claim 1, said body further comprising a clock mounted in said body.

39. The multipurpose mobile device of claim 38, wherein said clock further comprises an operable connection to said power hub.

40. A multipurpose mobile device comprising:

a. a body having a first side wall, a second side wall, a front wall, a rear wall, a top wall and a base;

b. said body containing an energy source to power said device operatively connected to a power hub configured to distribute energy within said device;

c. a spotlight mounted in a spotlight housing, and wherein said spotlight housing is pivotally mounted to said body;

d. a dimming switch operatively connected between said spotlight and said power hub, said dimming switch configured to control the voltage delivered to said spotlight, whereby the output of said spotlight may be increased or decreased as desired;

e. at least one side light module operatively mounted in said spotlight housing, and operatively connected to said power hub; and f. at least one energy outlet configured in said body, said outlet operatively connected to said power hub.

41. A multipurpose mobile device comprising:

a. a body having a first side wall, a second side wall, a front wall, a rear wall, a top wall and a base;

b. said body containing an energy source to power said device operatively connected to a power hub configured to distribute energy within said device;

c. a spotlight mounted in a spotlight housing, and wherein said spotlight housing is pivotally mounted to said body;

d. a dimming switch operatively connected between said spotlight and said power hub, said dimming switch configured to control the voltage delivered to said spotlight, whereby the output of said spotlight may be increased or decreased as desired;

e. at least one side light module operatively mounted in said spotlight housing, and operatively connected to said power hub;

f. a light emitting diode (LED) torch attached to said body, and operatively connected to said power hub; and g. at least one energy outlet configured in said body, said outlet operatively connected to said power hub.

* * * * *